United States Patent [19]

Vydrin et al.

[11] 4,267,720

[45] May 19, 1981

[54] MILL FOR ROLLING METAL STRIPS

[76] Inventors: Vladimir N. Vydrin, ulitsa Timiryazeva, 28, kv. 27; Leonid M. Ageev, ulitsa Rossiiskaya, 200, kv. 28; Anatoly P. Pellenen, ulitsa Degtyareva, 49a, kv. 48, all of Chelyabinsk, U.S.S.R.

[21] Appl. No.: 92,968

[22] Filed: Nov. 9, 1979

Related U.S. Application Data

[62] Division of Ser. No. 836,400, Sep. 26, 1977, abandoned.

[30] Foreign Application Priority Data

Nov. 17, 1976 [SU] U.S.S.R. ..... 2416651

[51] Int. Cl.[3] ..... B21B 39/08; B21B 1/28

[52] U.S. Cl. ..... 72/205; 72/366; 72/226

[58] Field of Search ..... 72/205, 234, 366, 199, 72/242, 226; 836/400

[56] References Cited

U.S. PATENT DOCUMENTS

| | | | |
|---|---|---|---|
| 2,095,733 | 10/1937 | Corgell | 72/205 X |
| 2,137,611 | 11/1938 | Hetler | 72/205 X |
| 3,238,756 | 3/1966 | Coffin, Jr. | 72/234 X |
| 3,309,908 | 3/1967 | Coffin, Jr. | 72/173 X |
| 3,605,470 | 9/1971 | Polahowski | 72/205 |
| 3,798,950 | 3/1974 | Franek | 72/205 |
| 3,871,221 | 3/1975 | Vydrin et al. | 72/205 |

*Primary Examiner*—Milton S. Mehr

*Attorney, Agent, or Firm*—Lackenbach, Lilling & Siegel

[57] ABSTRACT

The mill includes a stand on which at least three work rolls are mounted. At least two of the work rolls are secured in the roll housing chocks and provided with a drive means. The rolls rotate in opposite directions at different peripheral speeds increasing along the passline. At least one work roll is provided with a screw-down. The mill according to the invention for rolling metal strip is characterized by the axis of the middle work roll being offset with respect to the plane passing through the axes of the extreme work rolls towards the point where the metal strip being worked enters the first pair of work rolls, formed with the middle and the first extreme work rolls, as viewed in the direction of the passline, and towards the point of the metal strip emergence from the second pair of work rolls, formed with the middle work roll and the second extreme work roll. The rolling method according to the invention is characterized by the length of the deformation zones formed in the course of rolling between the first extreme work roll, as viewed in the direction of the passline, and the middle work roll and between the second extreme work roll, along the passline, and said middle work roll being less than half the circumference of said middle work roll.

9 Claims, 32 Drawing Figures

MILL FOR ROLLING METAL STRIPS

This is a division of application Ser. No. 836,400, filed Sept. 26, 1977, abandoned. cl BACKGROUND OF THE INVENTION 1. Field of the Invention The present invention relates to rolling and, in particular, to methods and mills for rolling metal strip.

2. Description of the Prior Art

There is known a method and an apparatus for rolling metal strips (L. F. Coffin Jr, Rolling method and apparatus, U.S. Pat. No. 3,309,908).

The method consists substantially of the rolling being conducted, in accordance with FIG. 1, in at least three work rolls, "A", "B" and "C", successively contacting one another through the strip "D" being rolled. The middle work roll "C" forms with the extreme work rolls "A" and "B" two deformation zones and its axis is offset with respect to the plane passing through the axes of said extreme work roll "A" and "B". In addition, the middle work roll "C" is idle and free to move under the tensioning action of the strip "D". The speeds of rotation of the work rolls increase along the path of rolling, adjacent rolls rotating in opposite directions.

According to FIG. 1, the strip "D" goes around the extreme work roll "A", deforms in a first deformation zone formed with the work rolls "A" and "C", passes around the work roll "C", deforms in a second deformation zone formed with the work rolls "B" and "C", and then goes around the second extreme work roll "B". The distance between said deformation zones along the circular arc of the work roll "C", which is the path of motion of the strip "D", is always greater than half the length of its circumference.

The above-mentioned patent also describes mills for rolling metal strips comprising a stationary working stand wherein at least three work rolls are placed. At least two work rolls are secured in chocks arranged in the working stand housing and provided with a drive means for rotating them in opposite directions at different peripheral speeds increasing along the path of rolling. At least one roll is provided with a screwdown. In such mills the axis of the middle work roll is offset with respect to the plane passing through the axes of the extreme work rolls in the direction opposite to the entry of the strip metal being rolled into the first pair of work rolls, formed with the middle and the first extreme work rolls, along the path of rolling and to the exit of the strip metal from the second pair of work rolls, formed with the middle and the second extreme work rolls.

The known method and mills for rolling metal strips suffer from a host of disadvantages which can best be illustrated by reference to FIG. 1.

FIG. 1 shows the arrangement of the work rolls and the strip being rolled and the forces acting upon the middle work roll "C" on the side of the first extreme work roll "A" along the path of rolling and the strip "D" being rolled.

According to FIG. 1, the condition of equilibrium of the middle work roll "C" may be written in the form $$P_z - T_z = 0 \quad (1)$$

where $P_z$ and $T_z$ are the components of the forces "P" and "T" along the Z-axis. Then $$P \cdot \cos\beta - T \cdot \sin\beta = 0 \quad (2)$$

i.e., $$P = T \cdot \tan\beta \quad (3)$$

Hence, the pressure "P" upon the strip being rolled is determined by the value of the tension "T" of said strip "D".

Due to a limited tensile strength of the strip and the risk of its rupturing, the specific tension practically used is never more than half the yield limit of the material involved ($0.5\delta_y$).

Thus, the condition (3) takes on the form:

$$P \leqq 0.5\delta y \cdot b \cdot h \cdot \tan\beta, \quad (4)$$

where b = width of the strip; and h = height of the strip.

Therefore, the possible pressure "P" and the deformation of the strip being rolled are very limited.

Another major disadvantage of the known rolling method and apparatus is that there is no possibility of using small diameter work rolls to reduce the pressure of the metal upon the rolls, in particular, when rolling wider sheets. This is because in the known rolling method, it is impossible to use backup rolls for minimizing the bending of the work rolls, since the strip being rolled goes around said work rolls.

In addition to the above described mills, also known are other types of mills for analogous applications having the same arrangement of work rolls and characteristic of which are the aforesaid disadvantages (J. Franek, Apparatus for Rolling Strip Metal, U.S. Pat. No. 3,253,445; P. H. Hume, Reduction of Elongated Bodies, U.S. Pat. No. 2,332,796, and others).

SUMMARY OF THE INVENTION

It is therefore an object of the present invention to provide a method and a mill for rolling strip metal which will increase the deformation of the strip, reduce its transverse uneven gauge and increase mill efficiency by a greater deformation of the strip per pass by increasing the pressures exerted by the working rolls upon the strip being rolled.

Another object of the invention is to eliminate slippage of the strip along the work rolls before it enters a pair of work rolls and after it leaves them.

Another object of the invention is to improve both the stability of the rolling process and the dimensional accuracy of finished items while, at the same time, increasing mill efficiency.

It is also an object of the invention to reduce the diameter of the extreme and the middle work rolls, to minimize the pressure of the metal upon the work rolls and to roll thinner strips as compared to known mills for analogous applications.

Still another object of the invention is to provide a mill for rolling strips from poorly plastic materials.

An object of the invention is also to provide a mill which will eliminate the bending of the deflecting roll due to the tensioning of the strip.

An additional object of the invention is to enhance efficiency of the proposed mill by a four-fold reduction of the strip in a single pass.

A further object of the invention is to increase the efficiency of the proposed mill by simultaneously rolling therein two strips.

A further object of the invention is to simplify the adjustment of the work roll system.

These and other objects are attained by a method for rolling strip metal, preferably in a cold state, by tensioning the free ends of the strip by at least three work rolls successively contacting one another through the strip being rolled and forming during rolling an even number of deformation zones. At least two of said three work rolls are rotated in the course of rolling at different peripheral speeds increasing along the path of rolling. Adjacent rolls are rotated in opposite directions. The strip being rolled is deformed in the first deformation zone, formed with the first extreme work roll, along the path of rolling, and the middle work roll, and then, in the second deformation zone, formed with the second extreme work roll, along the path of rolling, and said middle work roll.

In accordance with the invention, rolling is performed in a manner to maintain the distance between the first and the second roll, which is the path of motion of the strip, equal to less than half the length of the circumference of the middle work roll.

When rolling is performed according to the proposed method, the equilibrium of the middle work roll "C" is attained, as illustrated in FIG. 2, on condition that $$P_z+T_z=R/2 \tag{5}$$

where R = force applied by the screwdown against, e.g., the middle work roll "C".

Thence, $$P\cdot\cos\beta+T\cdot\sin\beta=R/2, \tag{6}$$

i.e., $$P=\frac{R}{2\cdot\cos\beta}-T\cdot\tan\beta \tag{7}$$

Since the pressure R by the screwdown can be made as great as desired, the deformation of strip "D" in rolling by the proposed method is only limited by the plastic properties of the strip metal being rolled and greatly exceeds the deformation attainable in the known method.

The present invention provides a method for rolling metal strip which makes it possible to increase the deformation of the strip and to minimize its transverse uneven gauge.

To the accomplishment of the foregoing and related ends, this invention consists of a mill for rolling metal strip including a decoiling and a coiling apparatus for the strip being rolled and a stationary working stand with at least three work rolls mounted therein. At least two of the rolls are secured in chocks arranged in the working stand housing and provided with a drive means for rotating them in opposite directions at different peripheral speeds increasing along the path of rolling. At least one work roll is provided with a screwdown. The axis of the middle work roll is offset relative to the plane passing through the axes of the extreme work rolls in the direction of entry of the strip being rolled in the first pair of work rolls, formed with the middle work roll and the first extreme work roll, along the path of rolling, and of exit of the strip from the second pair of work rolls, formed with the middle work roll and the second extreme work roll.

The present invention provides a mill for rolling metal strips which makes it possible to increase the rolling efficiency by increasing the deformation of the strip being rolled per pass by developing a large pressure upon the strip by the work rolls.

It is preferable to provide in the working stand housing a deflecting roll located, with respect to the middle work roll, on the opposite side relatively to the plane passing through the axes of the extreme work rolls and clear of the work rolls, and to arrange the deflecting roll axis in a plane passing through the axis of the middle work roll perpendicularly to the plane going through the axes of the extreme work rolls, thus making it possible to roll strips from poorly plastic materials which fail when wrapped around a small diameter roll.

It is advisable to provide between the middle work roll and the deflecting roll, in a plane passing through the axes of the middle work roll and the deflecting roll, an odd number of intermediate rolls in a manner to make said deflecting roll, at least one intermediate roll and the middle work roll contact successively each other, the intermediate roll being of such a diameter as to clear the extreme work rolls, thus eliminating the bending of the deflecting roll under the tensioning action of the strip.

BRIEF DESCRIPTION OF THE DRAWINGS

These and other objects of this invention will become apparent from the reading of the attached specification taken in conjunction with the accompanying drawings, wherein.

DESCRIPTION OF THE PREFERRED EMBODIMENTS

Figure 1:
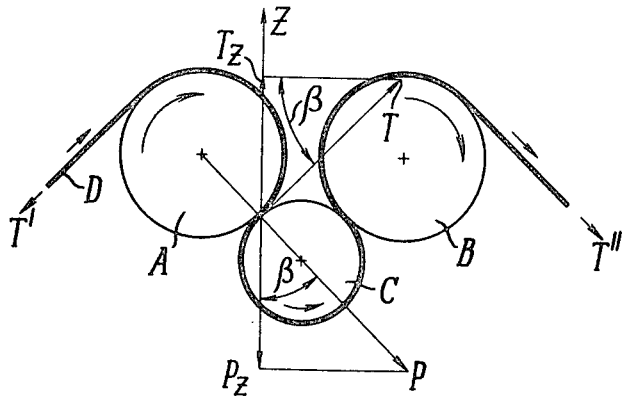
FIG. 1 is a schematic diagram showing the prior art arrangement of the work rolls and the strip being rolled, the axis of the middle work roll "C" being offset with respect to the plane passing through the axes of the extreme work rolls "A" and "B" in the direction opposite to that of entry of the strip being rolled "D" into the first pair of work rolls, "A" and "C", and of its exit from the second pair of work rolls, "B" and "C".
Figure 2:
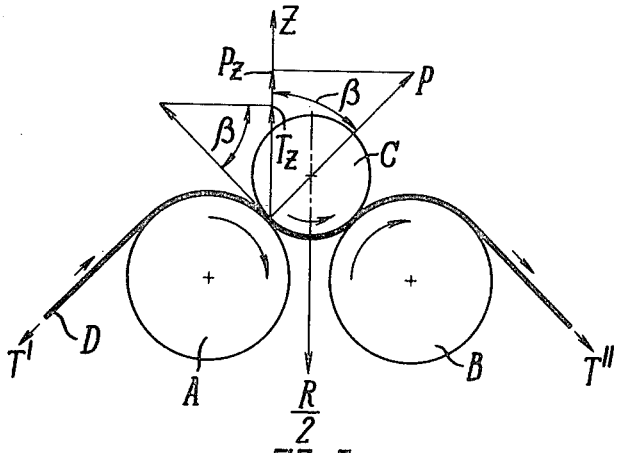
FIG. 2 is a schematic diagram of the invention, wherein the axis of the middle work roll "C" is offset with respect to the plane passing through the axes of the extreme work rolls "A" and "B" in the direction of entry of the strip "D" being rolled into the first pair of rolls, formed with the middle work roll "C" and the first extreme work roll "A" along the path of rolling, and of exit of the strip "D" from the second pair of work rolls, formed with the middle work roll "C" and the second extreme work roll "B".
Figure 3:
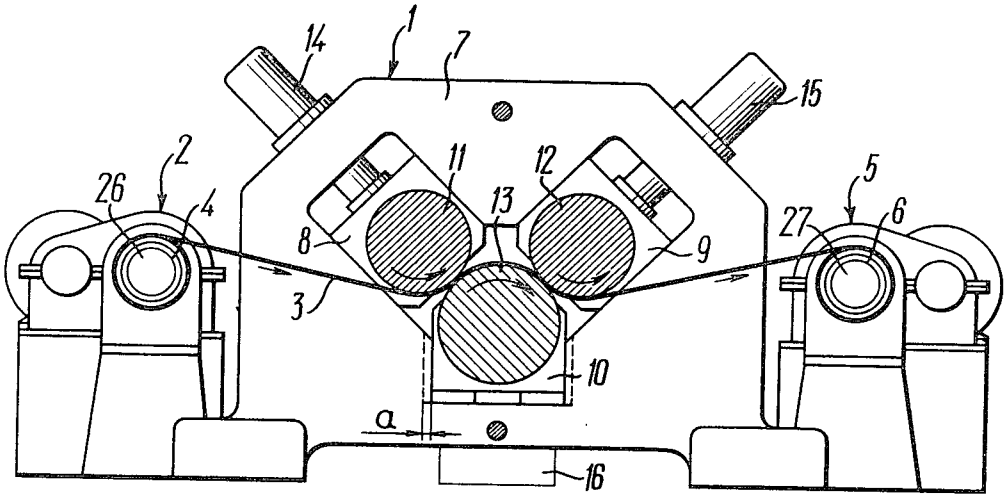
FIG. 3 is a side elevational view, partly in cross section along the line of rolling, of a mill with three work rolls realized according to the invention.

FIG. 3 is a schematic fragmentary sectional view along the line of rolling of a mill having a working stand 1, a decoiling apparatus 2 for uncoiling a strip 3 from a coil 4 and a coiling apparatus 5 for coiling said strip in a coil 6.

In a housing 7 of the working stand 1 chocks 8, 9 and 10 are mounted. In bearings (not shown on the drawing) situated in the chocks two extreme work rolls 11 and 12 and a middle work roll 13 are journalled. The axis of the middle work roll 13 is offset with respect to the plane passing through the axes of the extreme work rolls 11 and 12 in the direction of entry of the strip 3 being rolled in the first pair of work rolls 11 and 13 along the path of rolling and of exit of said strip from the second pair of work rolls 12 and 13. The housing 7 of the working stand 1 accommodates screwdowns 14 and 15 for actuating the chocks 8 and 9 of the extreme work rolls 11 and 12. Alternatively, the mill may be provided with a single screwdown 16 (shown in broken lines arranged on the side of the chock 10 of the middle work roll 13.

In FIG. 3 and in the following drawings, shown between the chock 10 of the middle work roll 13 and the housing 7 is a gap "a" which allows the chock 10 of the middle work roll 13 to move parallel to the plane passing through the axes of the extreme work rolls 11 and 12 and thus permits the middle work roll to self-align itself during rolling.

Figure 4:
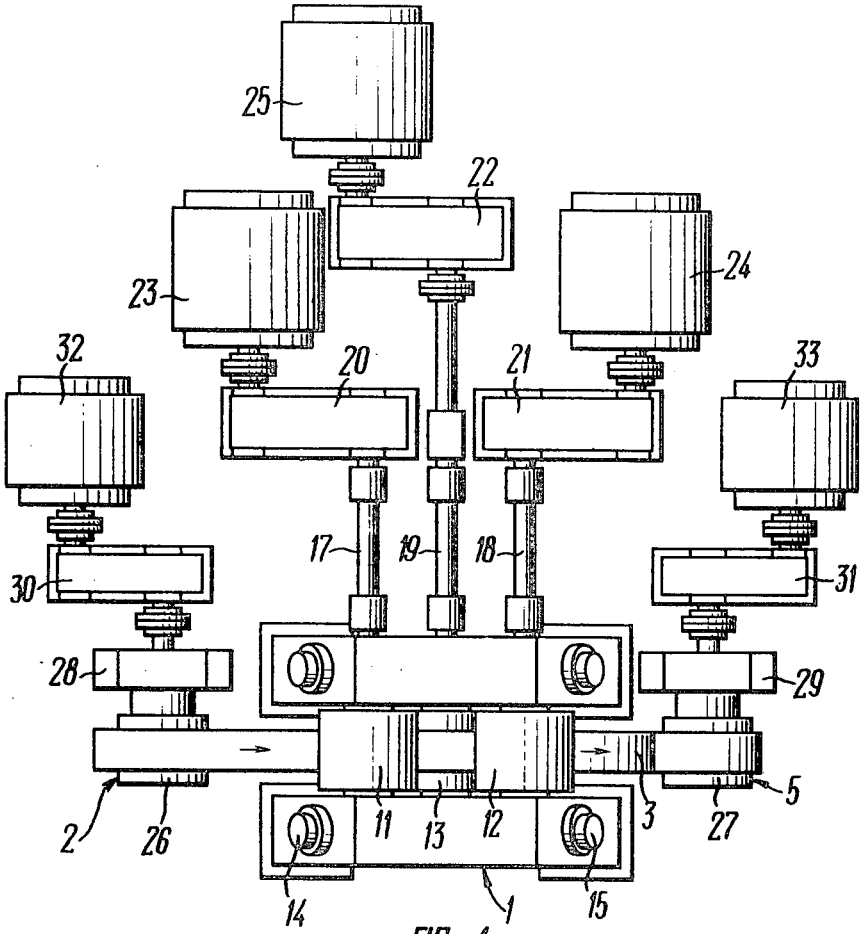
FIG. 4 is a top view of the device shown in FIG. 3.

FIG. 4 illustrates a top view of the aforesaid mill. According to this drawing, the mill is provided with drive means for rotating the work rolls 11, 12 and 13 including, respectively, spindles 17, 18 and 19, gearboxes 20, 21 and 22 and electric motors 23, 24 and 25. The decoiling apparatus 2 and the coiling apparatus 5 consist of, respectively, mandrels 26 and 27, mandrel supports 28 and 29, gearboxes 30 and 31, and electric motors 32 and 33. It should be noted that according to the invention the middle work roll 13 and the first extreme work roll 11 along the path of rolling may (one independently of the other) be idle. Omitted then is the drive means for the middle work roll 13 or the drive means for the first extreme work roll 11 along the path of rollling.

According to FIG. 3, the chock 10 of the middle work roll 13 is mounted for motion parallel to the plane passing through the axes of the extreme work rolls 11 and 12. This permits the middle work roll 13 to self-align itself with respect to the extreme work rolls 11 and 12.

The mill shown in FIGS. 3 and 4 operates as follows. The strip 3 to be rolled is fed from the decoiling apparatus 2 into the working stand 1, engaged into the first pair of work rolls 11 and 13, and then, into the second pair of work rolls 12 and 13, and is finally wound on the coiling apparatus 5. The leading edge of the strip 3 is secured to the mandrel 27 of the coiling apparatus 5. Screwdowns, e.g., 14 and 15, provide the required pressure of the rolls 11 and 12 upon the strip 3, and the decoiling apparatus 2 and the coiling apparatus 5 ensure the tensioning of the strip 3. The drive means of the work roll, the decoiling apparatus and the coiling apparatus are then energized, and rolling begins. The rotation of the work rolls and the motion of the strip are shown in FIG. 3 by arrows. During rolling, the work rolls are rotated by the drive means in opposite directions at different circumferential speeds increasing along the path of rolling. The strip 3 is deformed twice per pass as it goes through the pairs of work rolls 11 and 13 and 12 and 13. When rolling is completed, with two or three turns of the strip remaining on the mandrel 26 of the decoiling apparatus 2, the mill is shut down, the screwdowns e.g., 14 and 15, are re-adjusted to provide a different pressure upon the strip 3, and the decoiling and the coiling apparatus are adjusted to provide a different tensioning. Rolling is then initiated in the reverse direction, the coiling apparatus 5 and the decoiling apparatus 2 then exchanging functions.

Figure 5:
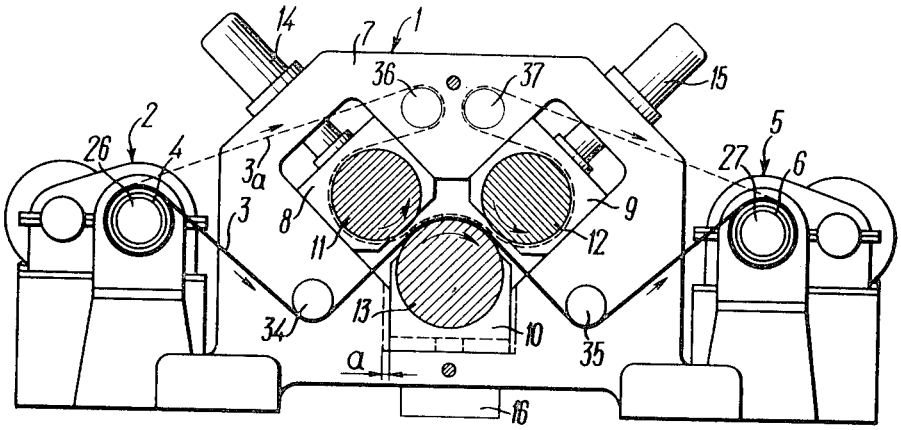
FIG. 5 is a side elevational view, partly in cross section, of a mill for rolling metal strip realized in accordance with the invention with three work rolls and two deflecting rolls, one on each side of the middle work roll.

FIG. 5 illustrates a mill whose particularity as compared to the mill shown in FIG. 3 is that the housing 7 of the working stand 1 includes two deflecting rolls 34 and 35. The deflecting roll 34 is arranged so that a tangent line drawn to the generatrix of said deflecting roll 34 located on the side of the middle work roll 13 from the point of contact of the extreme work roll 11 and the middle work roll 13 is perpendicular to a line connecting the axes of the extreme work roll 11 and the middle work roll 13. The deflecting roll 35 is mounted similarly.

This arrangement of the deflecting rolls 34 and 35 makes it possible to roll the strip 3 in a manner that prior to its engagement into the work rolls 11 and 13 and after it leaves the work rolls 12 and 13 it passes clear of said work rolls. Thus, notwithstanding the different velocity of motion of the strip 3 and the peripheral speeds of the work rolls 11, 12 and 3, strip surface is not marred by surfaces defects, such as scratches, scores and others.

FIG. 5 illustrates in broken lines an alternative arrangement of the deflecting rolls 36 and 37. The deflecting roll 36 is placed within a sector limited on one side by a tangent drawn from the point of contact of the rolls 11 and 13 and the perpendicular lines connecting the axes of the work rolls 11 and 13, and on the other side by a line drawn from the axis of the middle work roll 13 perpendicularly to a line connecting the axes of the extreme work rolls 11 and 12. The deflecting roll 37 is mounted similarly.

The deflecting rolls 36 and 37 make it possible to roll a strip "3*a*" by looping it around the extreme work rolls 11 and 12 through a certain angle. This is essential whenever it is necessary to ensure equality of the peripheral velocities of the extreme work rolls 11 and 12 and of the velocity of the strip 3 prior to its entry in the pair of work rolls 11 and 13 and after its exit from the pair of work rolls 12 and 13. Said equality is attained at the expense of the static friction forces at the point of contact of the strip 3 with the work rolls 11 and 12 along the arcs of contact. In this case the deformation of the strip is determined by the ratio of the peripheral velocities of the extreme work rolls 12 and 11, and the dimensional accuracy of finished products is thus improved.

Figure 6:
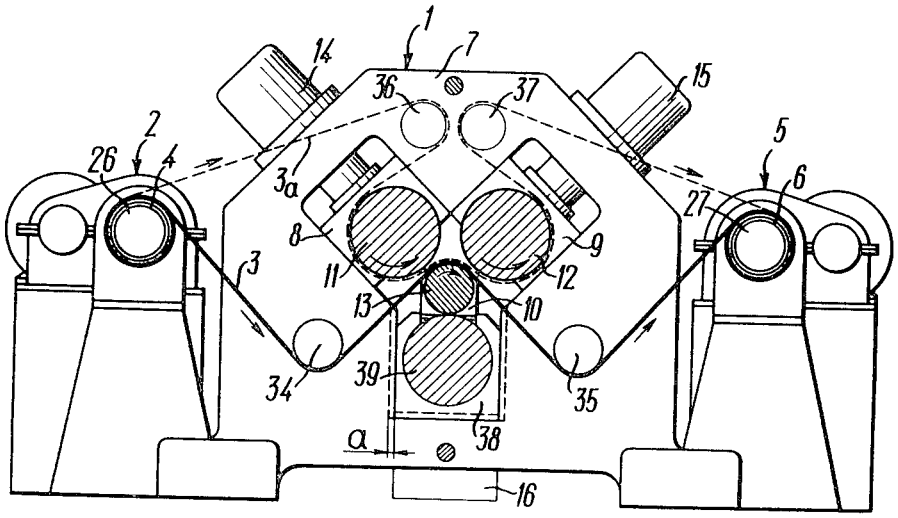
FIG. 6 is a side view similar to FIG. 5, but with the addition of a backup roll on the side of the middle work roll.

FIG. 6 illustrates a mill whose particularity as compared to the mill shown in FIG. 5 is that the housing 7 of the working stand 1 accommodates in a chock 38 at least one backup roll 39 contacting the middle work roll 13. The axis of the backup roll 39 lies in the plane passing through the axis of the middle work roll perpendicularly to the plane passing through the axes of the extreme work rolls 11 and 12. The use of the backup roll 39 makes it possible to reduce the diameter of the middle work roll 13, while retaining the rigidity of the roll system. This, in turn, diminishes the pressure of the metal upon the rolls, increases the deformation of the strip and provides for rolling thinner strips.

Figure 7:
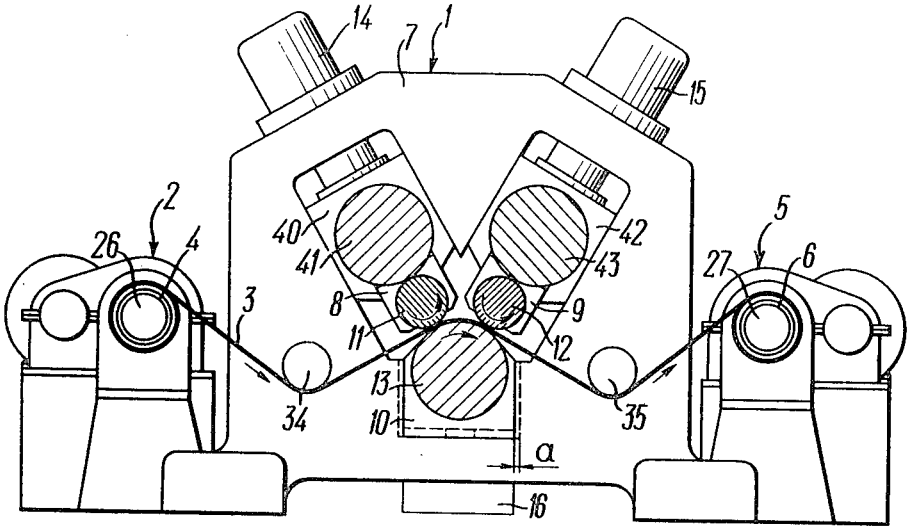
FIG. 7 is a schematic side elevational view, partly in cross section, of a mill for rolling metal strip realized according to the invention with three work rolls, there being one backup roll on each of the two extreme work rolls.

FIG. 7 illustrates a mill whose particularity as compared to the mill shown in FIG. 5 is that the housing 7 of the working stand 1 accommodates in a chock 40 a backup roll 41 contacting only extreme work roll 11. The axis of the backup roll 41 lies in the plane passing through the axis of the middle work roll 13 and the axis of the extreme work roll 11. As the FIG. 7 shows, a backup roll 43 is mounted similarly in a chock 42, said backup roll 43 contacting only the second extreme work roll 12. The mill, in accordance with the FIG. 7, makes it possible to reduce the diameter of the extreme work rolls, to minimize the pressure of the metal upon the rolls, to increase the deformation of the strip and to roll thinner strips.

Figure 8:
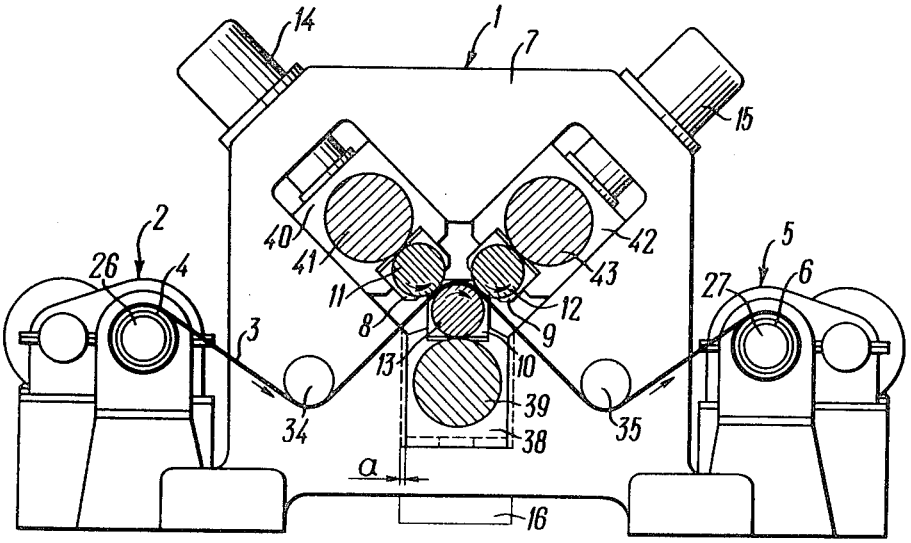
FIG. 8 is a side elevational view, partly in cross section, of a mill for rolling metal strip realized according to the invention in which each of the three work rolls are provided with one backup roll.

FIG. 8 illustrates an alternative embodiment of the mill differing from the one shown in FIG. 5 in that each of the work rolls 11, 12 and 13 contacts only a backup roll (respectively 41, 43 and 39). The principle underlying the arrangement of the backup rolls 39, 41 and 43 for said alternative embodiment of the mill has been described previously when discussing FIGS. 6 and 7. The use of the mill according to FIG. 8 makes it possible to minimize, to an even greater degree, the pressure of the metal upon the rolls, to increase the deformation of the strip and to roll thinner strips.

Figure 9:
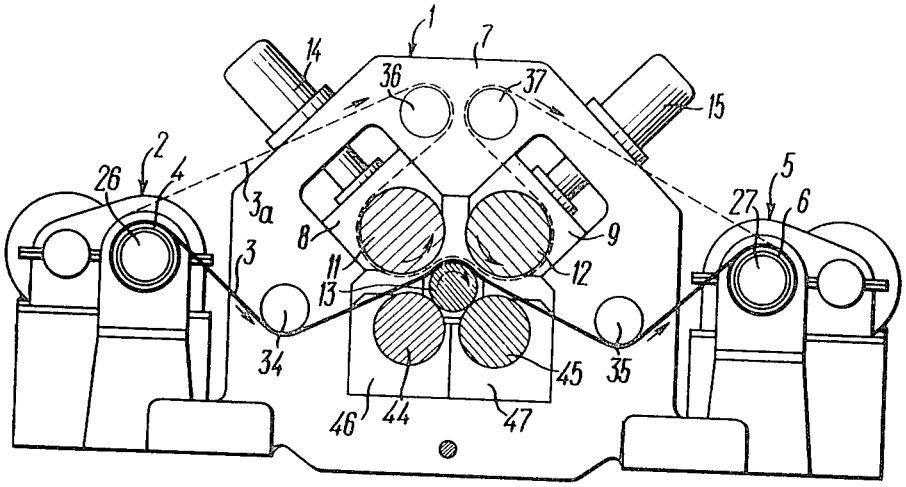
FIG. 9 is a side elevational view, partly in cross section, of a mill for rolling metal strip, realized according to the invention, having three work rolls, the middle one being provided with two backup rolls.

FIG. 9 illustrates a mill whose particularity, as compared to the mill shown in FIG. 5, is that the housing 7 of the working stand 1 supports in chocks 46 and 47 two backup rolls 44 and 45 contacting the middle work roll 13. The axes of said backup rolls lie in the plane parallel to that passing through the axes of the extreme work rolls 11 and 12. The use of the mill in accordance with FIG. 9 makes it possible to reduce the diameter of the middle work roll 13 and to lock it in position in the plane parallel to that passing through the axes of the extreme work rolls 11 and 12. An additional advantage is that the middle work roll 13 may then be mounted with no chocks.

Figure 10:
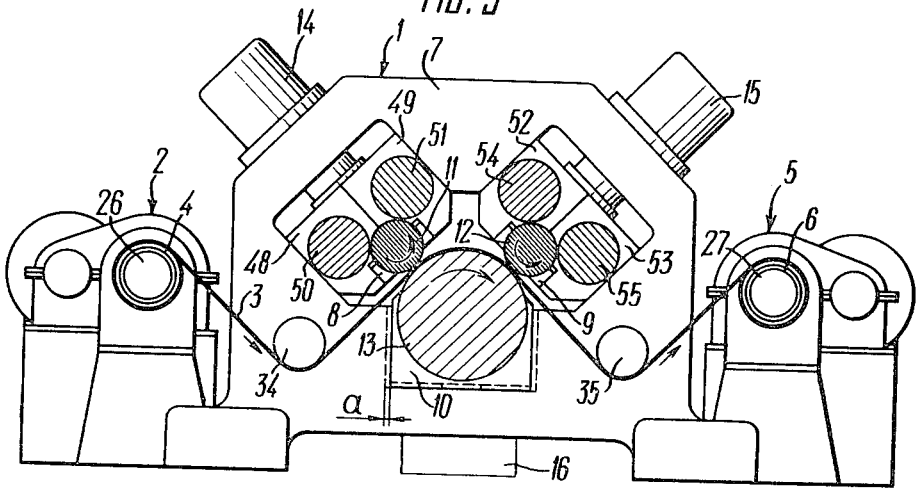
FIG. 10 is a side elevational view, partly in cross section, of a mill realized according to the invention, wherein each of the two extreme work rolls is provided with two backup rolls.

FIG. 10 illustrates a mill whose particularity as compared to the mill shown in FIG. 5 is that the housing 7 of the working stand 1 supports in chocks 48 and 49 two backup rolls 50 and 51 contacting only extreme work roll 11. Said backup rolls are mounted so that the plane passing through their axes is perpendicular to the plane passing through the axis of the middle work roll 13 and the axis of the extreme work roll 11. FIG. 10 also shows that backup rolls 54 and 55 contacting only the second extreme work roll 12 are mounted in chocks 52 and 53 in a similar manner. The use of the mill according to FIG. 10 makes it possible to reduce the diameters of the extreme work rolls 11 and 12 and also to lock them in position in the planes parallel to those passing through the axes of the pairs of backup rolls contacting them.

Figure 11:
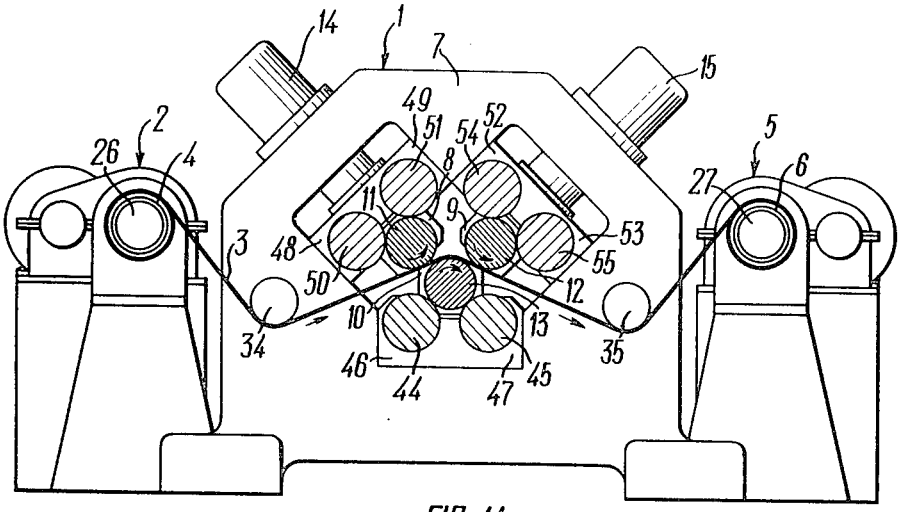
FIG. 11 is a side elevational view, partly in cross section, of a mill realized according to the invention wherein each of the three work rolls are provided with two backup rolls.

FIG. 11 illustrates a mill differing from the mill shown in FIG. 5 is that all the work rolls 11, 12 and 13 are in contact with two respective backup rolls. The use of this alternative mill makes it possible to stabilize the position of all the work rolls, to reduce their diameter, to increase the deformation of the strip and to roll thinner strips.

Figure 12:
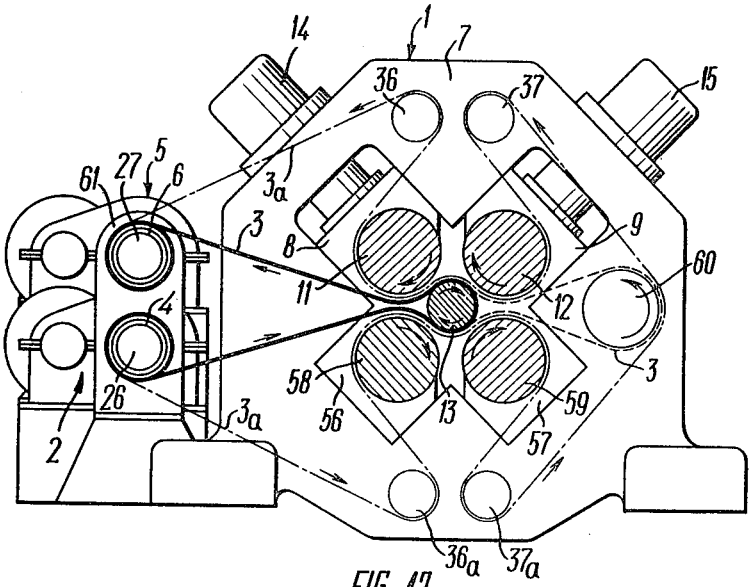
FIG. 12 is a side elevational view, partly in cross section, of a mill for rolling metal strip having five work rolls, a decoiling and a coiling apparatus arranged on one side of the stand, and a deflecting roll provided on the opposite side of the stand.

FIG. 12 illustrates a mill whose distinction, as compared to the ones shown in FIGS. 3 and 5, is that it is provided with two additional extreme work rolls 58 and 59 mounted in chocks 56 and 57 in the housing 7 of the working stand 1 symmetrically with respect to the middle work roll 13. The decoiling apparatus 2 and the coiling apparatus 5 are placed on the same side (the left-hand one) of the working stand 1. In this case, the strip 3 being rolled goes around the middle work roll 13 as is shown in a solid line. A tensioning roll 60 maybe provided on the other side of the stand with respect to the set of work rolls 11, 12, 13, 58 and 59 to adequately tension the strip. The strip 3 and the roll 60 are shown in broken lines. A second alternative of the path of the strip "3*a*" in the mill is shown in FIG. 12 in a broken line. Deflecting rolls 36 and 37 are then used to loop the strip around the work rolls 11 and 12, respectively, and deflecting rolls 36a and 37a are used to loop the strip around the extreme work rolls 58 and 59, respectively.

Figure 13:
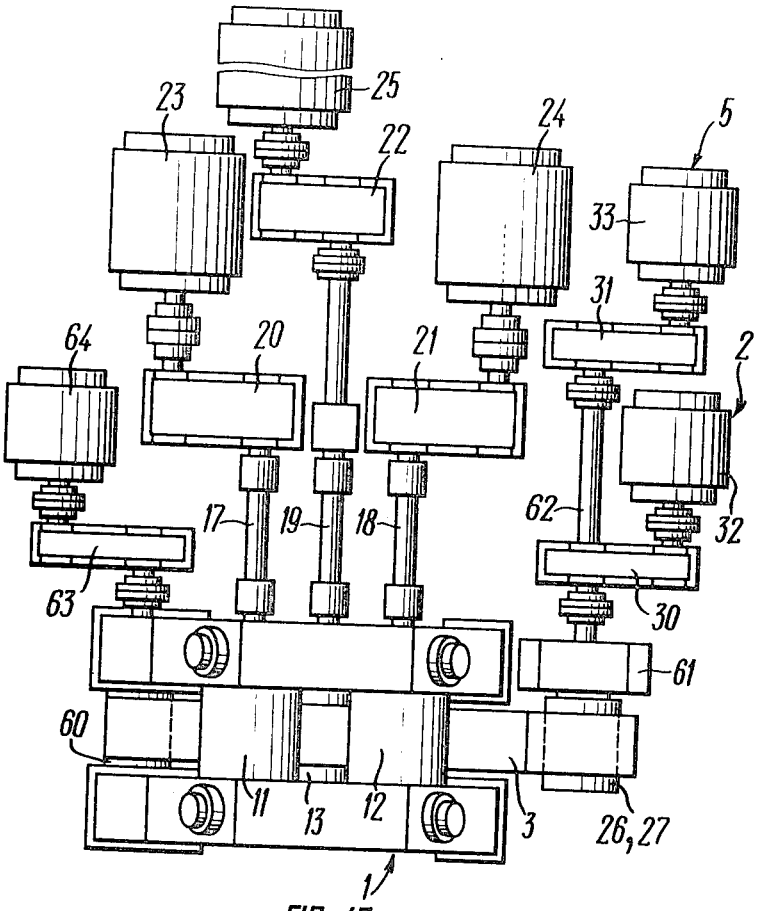
FIG. 13 is a top view of the device shown in FIG. 12.

FIG. 13 is a top view of the mill shown in FIG. 12. According to this embodiment the mandrels 26 and 27 of the decoiling apparatus 2 and of the coiling apparatus 5 are placed on the right of the working stand 1 on a common support 61 one above the other. The drive means of the decoiling apparatus 2 includes a gearbox 30 and an electric motor 32 and the drive means of the coiling apparatus 5 comprises an electric motor 33 and a gearbox 31 geared to the mandrel 26 by an intermediate shaft 62. The tensioning roll 60 is also provided with a drive means consisting of a gearbox 63 and an electric motor 64.

The mill shown in FIGS. 12 and 13 operates as follows. The strip 3 is fed from the decoiling apparatus 2 to the work stand 1, engaged into the pair of work rolls 11 and 13 and then into the work rolls 12 and 13 looped around the middle work roll 13 or around the tensioning roll 60, passed through the pair of work rolls 13 and 59 and then the pair of work rolls 13 and 58, and then wound on the coiling apparatus 5 where the leading edge of the strip 3 is secured in the mandrel 27. The screwdowns 14 and 15 provide the necessary pressure of all the rolls upon the strip 3, which is also tensioned with the aid of the decoiling apparatus 2 and the coiling apparatus 5. Drive means are then energized and rolling is initiated. The rotation of the work rolls and the direction of motion of the strip are shown by arrows. The mill is shut down when two or three turns remain on the mandrel of the decoiling apparatus 2. The pressure and the tensioning are adequately re-adjusted with the aid of, respectively, the screwdowns 14 and 15 and the decoiling apparatus 2 and the coiling apparatus 5. The drive means are then energized to roll the strip in the opposite direction, the decoiling apparatus 2 and the coiling apparatus 5 then exchanging functions.

The use of the mill according to FIGS. 12 and 13 substantially increases its efficiency, since the strip is reduced four times in a single pass.

Figure 14:
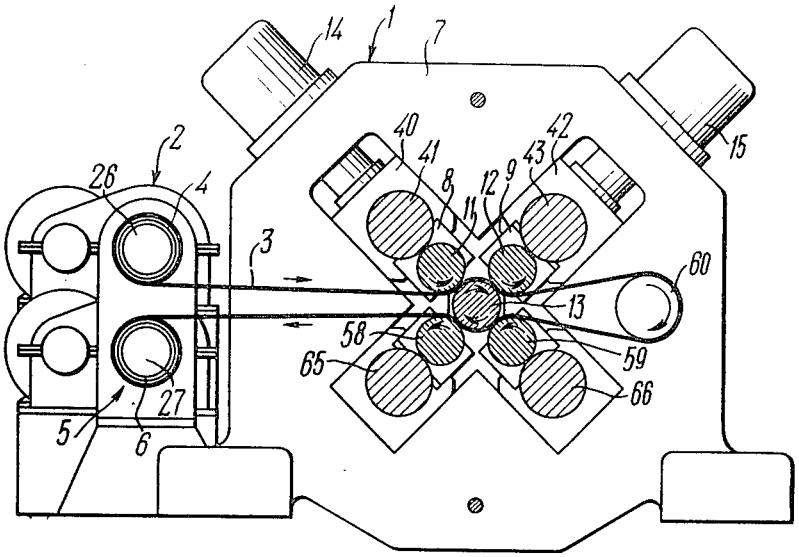
FIG. 14 is a side view similar to FIG. 12, but each extreme work roll is provided additionally with a backup roll.

FIG. 14 illustrates a mill whose main particularly as compared to the one shown in FIG. 12 is that each of the extreme work rolls 11, 12, 58 and 59 contacts a respective backup roll (backup rolls 41, 43, 65 and 66 respectively). The principle underlying the arrangement of said backup rolls is the same as that in the mill shown in FIG. 8.

The use of the backup rolls 41, 43, 65 and 66 makes it possible to reduce the diameter of the extreme work rolls 11, 12, 58 and 59, to minimize the pressure of metal upon the rolls, to increase the deformation of the strip and to roll thinner strips.

Figure 15:
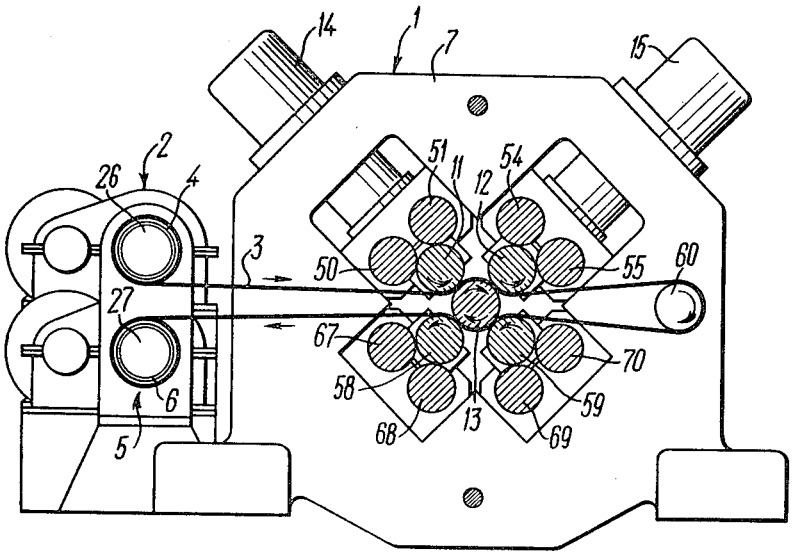
FIG. 15 is a side view similar to FIG. 12, but each extreme work roll is provided additionally with two backup rolls.

FIG. 15 illustrates a mill differing from that shown in FIG. 12 in that each of the extreme work rolls 11, 12, 58 and 59 contacts two backup rolls (pairs of respective backup rolls 50 and 51, 54 and 55, 67 and 68 and 69 and 70 respectively). The principle underlying the arrangement of these pairs of backup rolls is the same as that in the mill shown in FIG. 11. The use of the pairs of backup rolls 50 and 51, 54 and 55 , 67 and 68 and 69 and 70 makes it possible to reduce the diameters of the extreme work rolls 11, 12, 58 and 59. In addition, in the mill shown in FIG. 15, said extreme work rolls are locked in position by the backup rolls in the planes parallel to the planes passing through the axes of each pair of said backup rolls.

Figure 16:
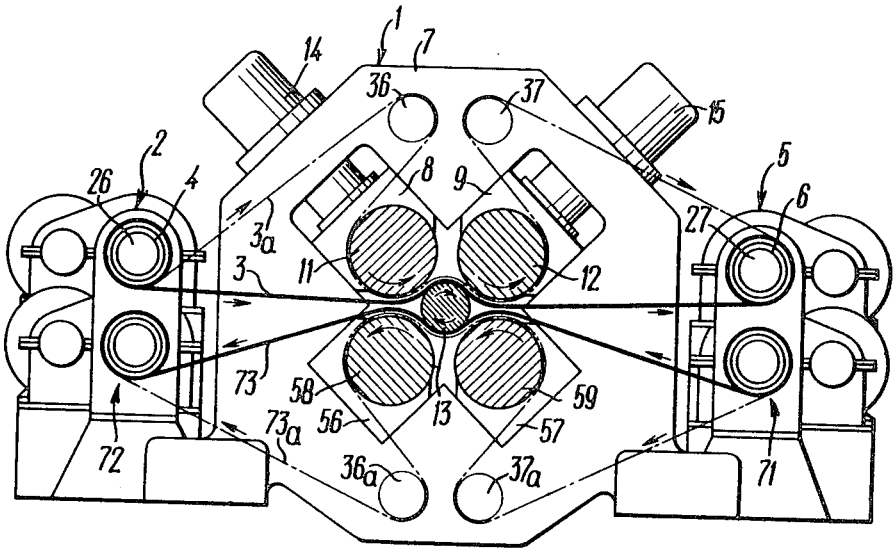
FIG. 16 is a side elevational view, partly in cross section, of a mill for rolling metal strip having five work rolls and a decoiling and a coiling apparatus on each side of the stand for simultaneous rolling of two strips.

FIG. 16 illustrates a mill differing from the mill shown in FIGS. 3 and 5 in that it additionally includes, symmetrically with respect to the middle work roll 13, in chocks 56 and 57 of the housing 7 of the working stand 1, two extreme work rolls 58 and 59 rotated by a drive means in the same direction as the extreme work rolls 11 and 12. Moreover, the mill is additionally provided with a decoiling apparatus 71 and a coiling apparatus 72 for rolling a strip 73 simultaneously with the strip 3. The rotation of the work rolls 11, 12, 13, 58 and 59 and the motion of the strip 3 and 73 being rolled are shown by arrows on FIG. 16.

An alternative path of motion of strips 3a and 73a in the mill is shown in FIG. 16 by broken lines. The deflecting rolls 36 and 37 are then used to loop the strip 3a around the extreme work rolls 11 and 12, respectively and the deflecting rolls 36a and 37a are used to loop the strip 73a around the extreme work rolls 58 and 59, respectively.

The mill shown in FIG. 16 operates as follows. The strip 3 to be rolled is fed from the decoiling apparatus 2 to the work stand 1, engaged into the pair of work rolls 11 and 13 and then into the pair of work rolls 12 and 13, and wound on the mandrel 27 of the coiling apparatus 5 wherein the leading edge of the strip is secured. In an alternative procedure, the strip 3*a* is fed from the decoiling apparatus 2 to the deflecting roll 36, looped around it, engaged into the pair of work rolls 11 and 13 and then into the pair of work rolls 12 and 13, passed around the deflecting roll 37 and wound on the mandrel 27 of the coiling apparatus 5, wherein the leading edge of the strip 3*a* is secured.

The second strip 73 is similarly threaded into the mill according to the aforesaid procedure, and the strip 73*a* is threaded according to the alternative procedure. The required pressure is provided from all the work rolls with the aid of the screwdowns 14 and 15, and the strips 3 and 73 or 3*a* and 73*a* are adequately tensioned with the aid of the decoiling apparatus 2 and 71 and the coiling apparatus 5 and 72. Drive means are then energized and rolling is initiated. The mill is shut down when two or three turns of the strip remain on the mandrels of the decoiling apparatus 2 and 71. The pressure upon the strips 3 and 73 is then re-adjusted with the aid of the screwdowns 14 and 15, and the strips are re-tensioned with the aid of the decoiling and the coiling apparatus. The drive means are then energized to roll the strips 3 and 73 or 3*a* and 73*a* in the opposite directions, the decoiling apparatus 2 and 71 and the coiling apparatus 5 and 72 then exchanging functions.

Figure 17:
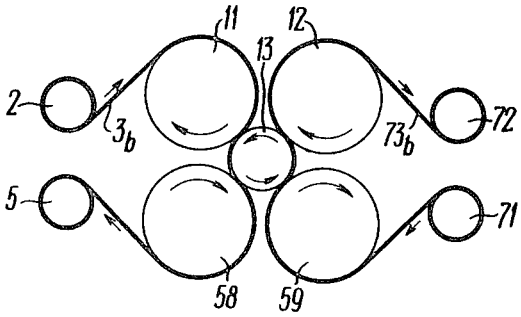
FIG. 17 is a schematic diagram of an alternative embodiment of the mill for rolling metal strips illustrated in FIG. 16.

FIG. 17 illustrates another alternative path of motion of the strips 3*b* and 73*b* being rolled and the arrangement of the decoiling apparatus 2 and 71 and of the coiling apparatus 5 and 72 with respect to the work rolls 11, 12, 13, 58 and 59. In this case, the decoiling apparatus 2 and the coiling apparatus intended for rolling the strip 3*b* are arranged on the same side of the work rools and the decoiling apparatus 71 and the coiling apparatus 72 intended for rolling the strips 73*b* are placed on the opposite side of said work rolls.

The mill in accordance with FIG. 17 operates as follows. The strip 3*b* is fed from the decoiling apparatus 2 to the work stand 1, engaged in the pair of work rolls 11 and 13 and then in the pair of work rolls 13 and 58, and finally wound on the coiling apparatus 5. The strip 73*b* from the decoiling apparatus 71 is fed to the work stand 1, in the engaged pair of work rolls 59 and 13 and then in the work rolls 12 and 13 and finally wound on the coiling apparatus 72. The rotation of the work rolls 11, 12, 13, 58 and 59 and the motion of strips 3*b* and 73*b* are shown by arrows in FIG. 17. The mill operates similarly to that shown on FIG. 16.

The use of the mills illustrated in FIGS. 16 and 17 makes it possible to substantially increase production efficiencies due to simultaneous rolling of two strips.

Figure 18:
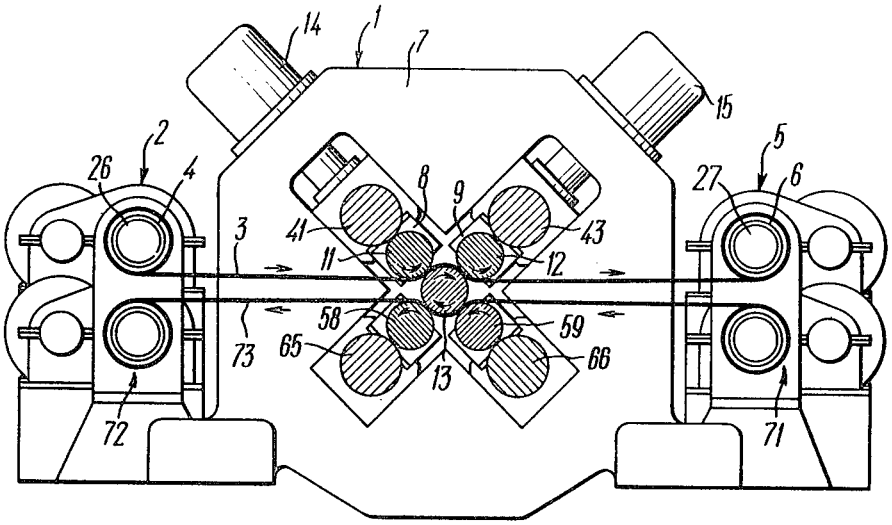
FIG. 18 is a side view similar to FIG. 16, but each extreme work roll is provided additionally with one backup roll.

FIG. 18 illustrates a mill whose particularity as compared to the mill shown in FIG. 16 is that each of the extreme work rolls 11, 12, 58 and 59 contacts one respective backup roll (backup rolls 41, 43, 65 and 66 respectively). The principle underlying the arrangement of the backup rolls is the same as that in the mill illustrated on FIG. 8.

The use of the mill according to FIG. 18 makes it possible to reduce the diameters of the extreme work rolls 11, 12, 58 and 59, to minimize the pressure of the metal upon the rolls, to increase the deformation of the strips and to roll thinner strips.

Figure 19:
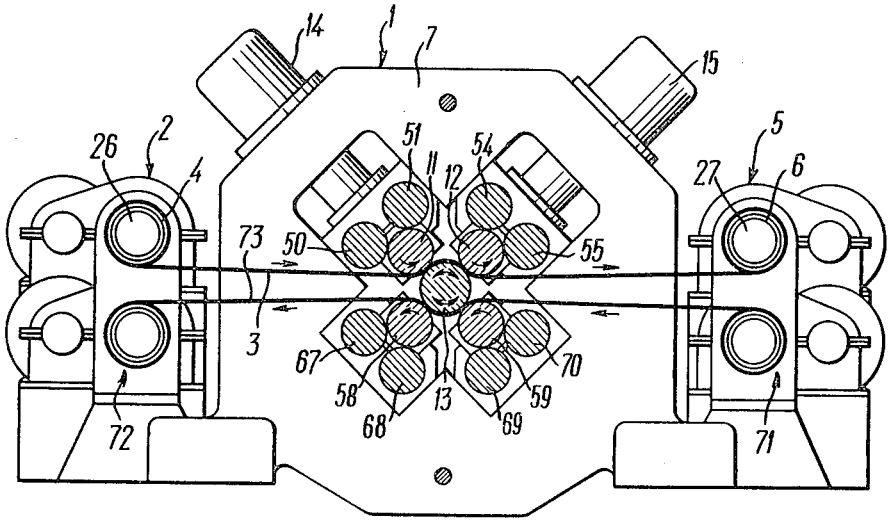
FIG. 19 is a side view similar to FIG. 16, but each extreme work roll is provided additionally with two backup rolls.

FIG. 19 illustrates a mill, wherein, in contrast to the mill shown in FIG. 16, each of the extreme work rolls 11, 12, 58 and 59 contacts two respective backup rolls (pairs of backup rolls 50 and 51, 54 and 55, 67 and 68 and 69 and 70 respectively). The principle of arrangement of said pairs of backup rolls is the same as that in a mill shown in FIG. 11.

The use of the mill according to FIG. 19 makes it possible to reduce the diameter of the extreme work rolls 11, 12, 58 and 59, to minimize the pressure of the metal upon the rolls, to increase the deformation of the strip and to roll thinner strips. In addition, the extreme work rolls 11, 12, 58 and 59 are then locked in position in planes parallel to ones passing through the axes of the pairs of backup rolls in contact therewith.

Figure 20:
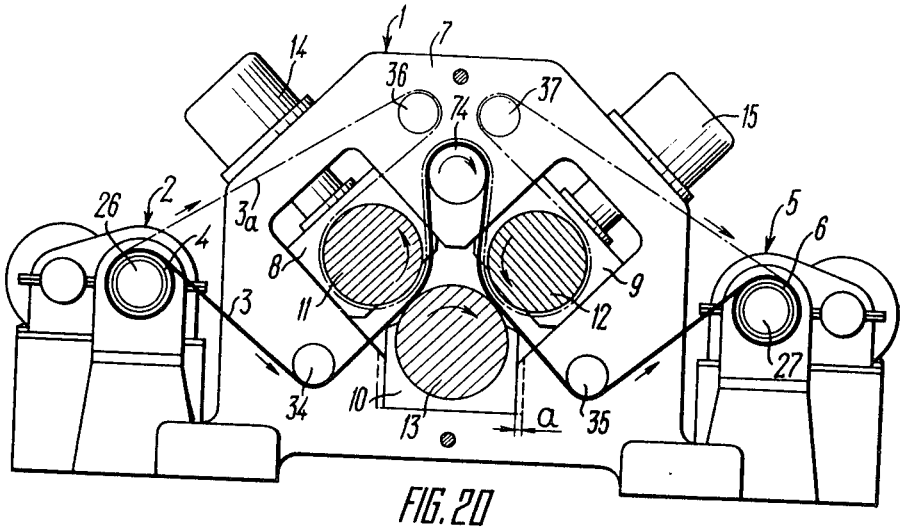
FIG. 20 is a side elevational view, partly in cross section, of a mill for rolling metal strip, realized in accordance with the invention, having three work rolls and one deflecting roll arranged on the side of the extreme work rolls clear thereof.

FIG. 20 shows a mill differing from the mill illustrated in FIG. 5 in that a deflecting roll 74 is provided in the housing 7 of the working stand 1 on the side opposite to the middle work roll 13 relative to the plane passing through the axes of the extreme work rolls 11 and 12. The axis of the deflecting roll lies in the plane passing through the axis of the middle work roll 13 perpendicularly to the plane passing through the axes of the extreme work rolls 11 and 12. The deflecting roll 74 is mounted in a manner that it clears the strip 3 from the work rolls 11, 12 and 13.

The mill shown in FIG. 20 operates as follows. The strip 3 from the decoiling apparatus 2 is fed to the deflecting roll 34, passes around it, enters the pair of work rolls 11 and 13, goes around the deflecting roll 74, enters the pair of work rolls 12 and 13, passes around the deflecting roll, 35 and wound around by the coiling apparatus 5. From this point on, the mill shown in FIG. 20, operates similarly to the mill shown in FIG. 3.

FIG. 20 illustrates an alternative path of motion of the strip 3*a* (broken line) in the mill. The strip 3*a* is unwound from the decoiling apparatus 2 to the deflecting roll 36, goes around it and the work roll 11, enters the pair of work rolls 11 and 13, passes around the deflecting roll 74, engages the pair of work rolls 12 and 13, loops around the work roll 37 and wound around in the coiling apparatus 5.

The mill according to FIG. 20 makes possible the use of the deflecting roll 74 of a diameter larger than that of the middle work roll 13 and thus provides a possibility of rolling strips of poorly plastic materials which cannot be done with rolls of a small diameter.

Figure 21:
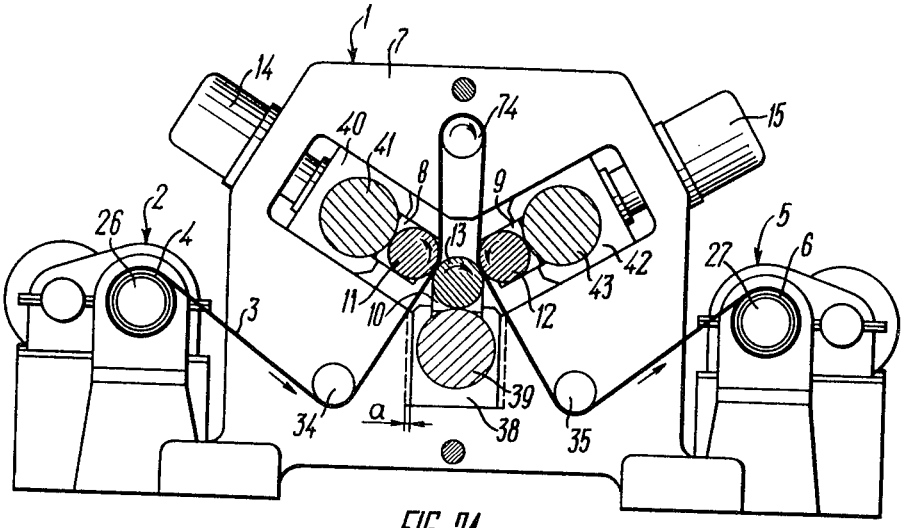
FIG. 21 is a side view similar to FIG. 20, but each work roll is provided additionally with a backup roll.

FIG. 21 illustrates a mill which differs from the one shown in FIG. 20 in that each of the three work rolls 11, 12, 13 contacts one respective backup roll (backup rolls 41, 43, 39 respectively). The principle underlying the arrangement of the backup rolls is the same as that in the mill according to FIG. 8.

The use of the mill according to FIG. 21 makes it possible to reduce the diameters of the work rolls 11, 12 and 13, to minimize the pressure of metal upon the rolls, to increase the deformation of strip and to roll thinner strips.

Figure 22:
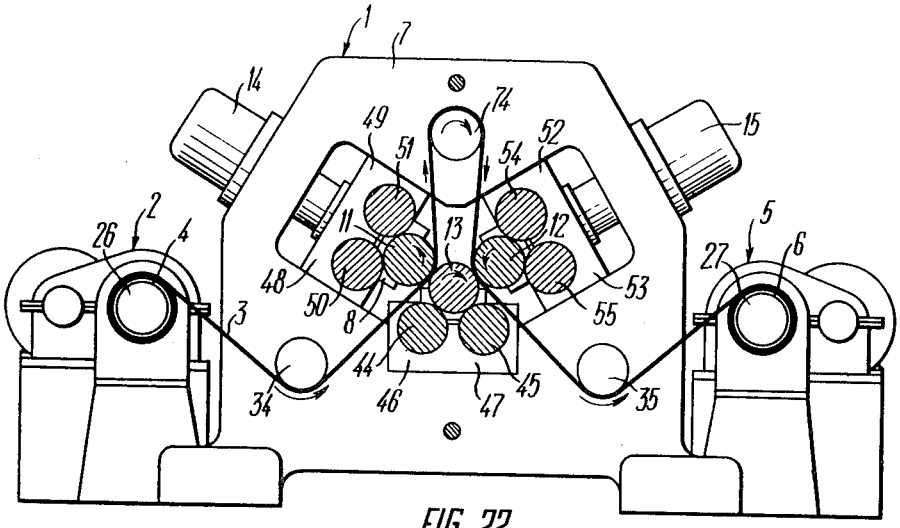
FIG. 22 is a side view similar to FIG. 20, but the work rolls are provided each with two backup rolls.

FIG. 22 illustrates a mill differing from the one shown in FIG. 20 in that each of the three work rolls 11, 12 and 13 contacts two respective backup rolls (pairs of backup rolls 50 and 51, 54 and 55 and 44 and 45 respectively). The principle underlying the arrangement of the backup rolls is the same as that in the mill shown in FIG. 11.

The use of the mill according to FIG. 22 makes it possible to reduce the diameters of the work rolls 11, 12 and 13, to minimize the pressure of metal upon the rolls, to increase the deformation of the strip and to roll thinner strips. In addition, the work rolls 11, 12 and 13 are locked in position in planes parallel to ones passing through the axes of the pairs of backup rolls contacting them.

Figure 23:
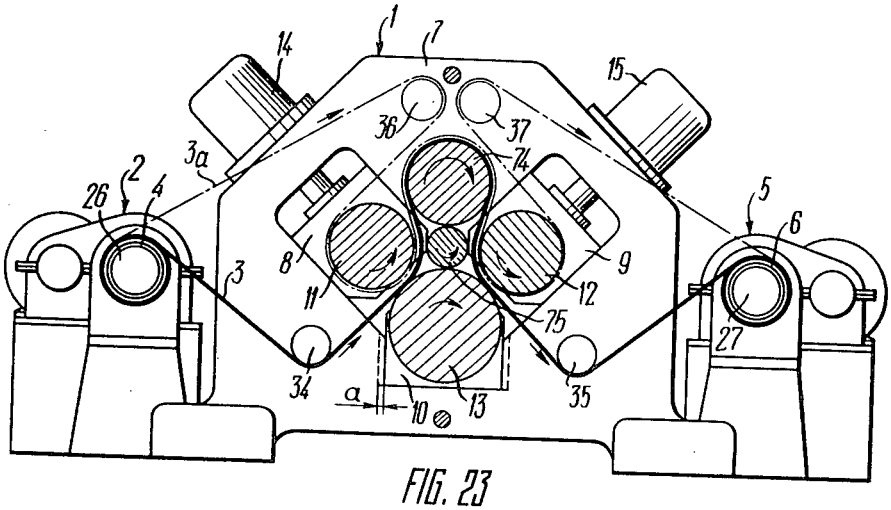
FIG. 23 is a side elevational view, partly in cross section, of a mill for rolling metal strip, realized according to the invention, having three work rolls, a deflecting roll and an intermediate roll arranged between the middle work roll and the deflecting roll, and two deflecting rolls provided on the side of the middle work roll and on that of the two extreme work rolls.

FIG. 23 illustrates a mill differing from the one shown in FIG. 20 in that an intermediate roll 75 (the mill may be provided with an odd number of intermediate rolls) is provided between the deflecting roll 74 and the middle work roll 13. The intermediate roll 75 contacts the deflecting roll 74 and the middle work roll 13. The intermediate roll 75 is mounted so that it clears the extreme work rolls 11 and 12. The axis of the intermediate roll 75 lies in a plane passing through the axis of the middle work roll 13 and the axis of the deflecting roll 74.

FIG. 23 illustrates two alternatives of the motion of the strips in the mill, that of the strip 3 (solid line) and that of the strip 3*a* (broken line).

The mill according to FIG. 23 operates similarly to the mill illustrated in FIG. 20.

The use of an odd number of intermediate rolls (at least one roll 75) makes it possible to prevent the bending deformation of the deflecting roll 74 under the tensioning action of the strip 3.

Figure 24:
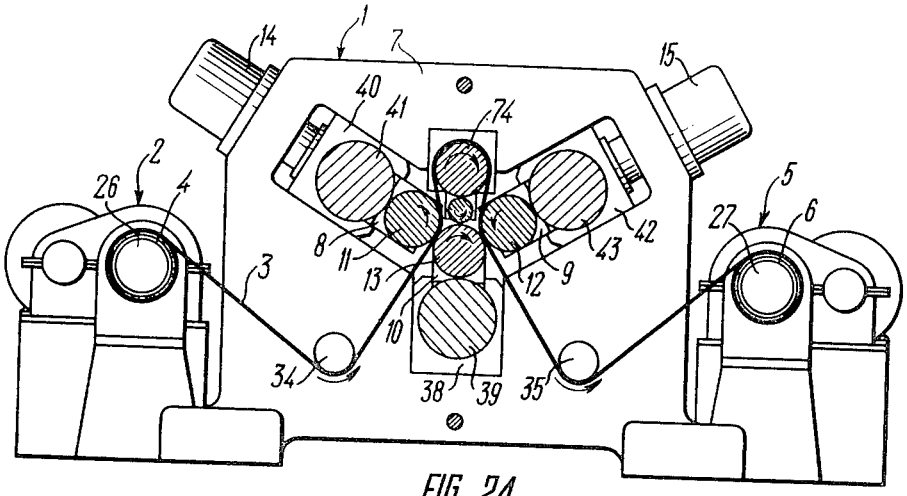
FIG. 24 is a side view similar to FIG. 23, but each work roll is provided additionally with one backup roll.

FIG. 24 illustrates a mill which differs from the mill shown in FIG. 23 in that each of the three work rolls 11, 12 and 13 contacts one respective backup roll (backup rolls 41, 43 and 39 respectively). The principle underlying the arrangement of the backup rolls is the same as that in the mill according to FIG. 8.

The use of the mill according to FIG. 24 makes it possible to reduce the diameters of the work rolls 11, 12 and 13, to minimize the pressure of metal upon the rolls, to increase the deformation of the strip and to roll strips of a smaller thickness.

Figure 25:
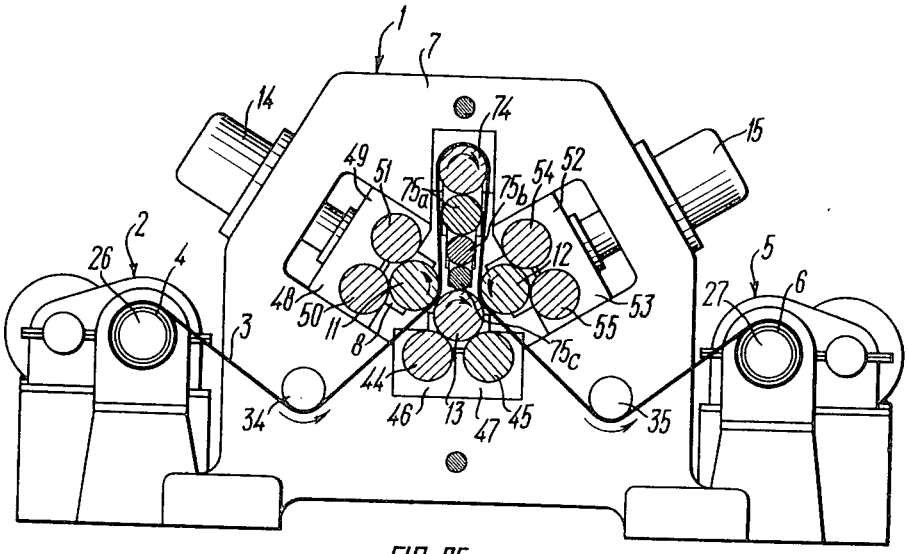
FIG. 25 is a side view similar to FIG. 23, but each work roll is provided additionally with two backup rolls.

FIG. 25 illustrates a mill which differs from the mill according to FIG. 23 in that each of the three work rolls 11,12 and 13 contacts two respective backup rolls (pairs of backup rolls 50 and 51, 54 and 55 and 44 and 45 respectively). The principle underlying the arrangement of the backup rolls is that same as that in the mill shown in FIG. 11.

In addition, the mill according to FIG. 25 is provided with three intermediate rolls 75*a*, 75*b*, 75*c* between the deflecting roll 74 and the middle work roll 13, the deflecting roll 74 and the intermediate rolls 75*a*, 75*b* and 75*c* successively contacting each other.

The use of the mill according to FIG. 25 makes it possible to reduce the diameters of the work rolls 11, 12 and 13, to minimize the pressure of metal upon the rolls, to increase the deformation of the strip and to roll thinner strips. Additionally, the intermediate rolls 75*a*, 75*b*, 75*c* prevent the bending of the deflecting roll 74 due to the tensioning of the strip 3.

Figure 26:
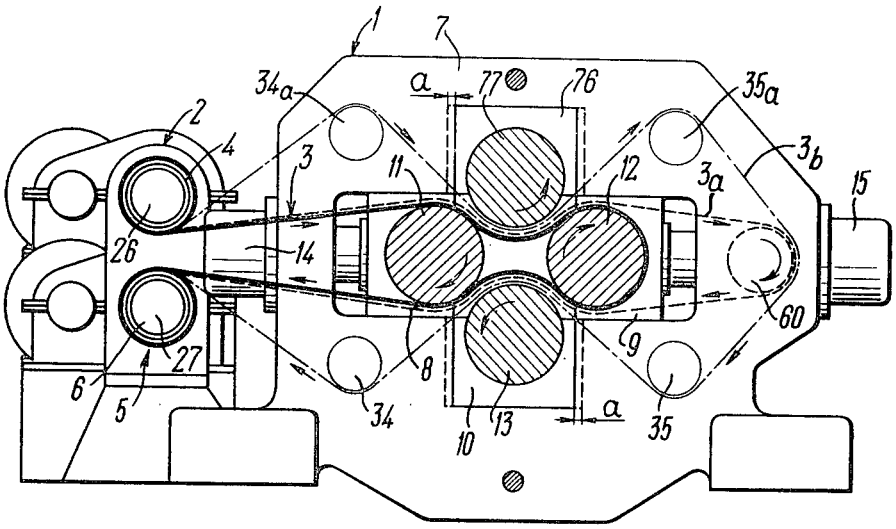
FIG. 26 is a side elevation view, partly in cross section, of a mill for rolling metal strip, realized according to the invention, having four work rolls, a decoiling and a coiling apparatus provided on one side of the stand and a tensioning roll provided on the opposite side of the stand.

FIG. 26 illustrates a mill differing from the mill shown in FIGS. 3 and 5 in that an additional middle work roll 77 is mounted in the housing 7 of the work stand in chock 76 symmetrically with respect to the plane passing through the axes of the extreme work rolls 11 and 12. The decoiling apparatus 2 and the coiling apparatus 5 are placed on the same side of the working stand 1.

The mill according to FIG. 26 operates as follows. The strip 3 (solid line) is fed from the decoiling apparatus 2, engages the pair of work rolls 11 and 77 and then the pair of work rolls 77 and 12, passes around the work roll 12, enters the pair of work rolls 12 and 13 and, then the pair of work rolls 13 and 11, and is wound around to the coiling apparatus 5. Adequate pressures are provided between the work rolls 11, 77, 12 and 13 with the aid of the screwdowns 14 and 15 and the strip 3 is tensioned as required by means of the decoiling apparatus 2 and the coiling apparatus 5. Respective drive means are then energized and the rolling of the strip 3 is thus initiated. From this point on, the operation of the mill is similar to that of the mill according to FIG. 12.

FIG. 26 shows an alternative embodiment of the mill differing in that provided beyond the second extreme work roll 12 along the path of rolling is a tensioning roll 60 (shown in broken line) with a drive means similar to that in the mill according to FIG. 12. The tensioning roll makes it possible to increase the tensioning of the strip 3a (shown in broken line). The strip 3a is fed from the decoiling apparatus 2, engages the pair of work rolls 11 and 77 and then the pair of work rolls 77 and 12, passes around the tensioning roll 60, enters the pair of work rolls 12 and 13 and then the rolls 11 and 13, and is wound around the coiling apparatus 5.

According to a third embodiment of the mill as shown in FIG. 26, the strip 3b (shown in broken lines) is fed from the decoiling apparatus 2 passes around a deflecting roll 34a, enters the pair of work rolls 11 and 77 and then the pair of work rolls 77 and 12, goes around the deflecting roll 35a, the tensioning roll 60 and the deflecting roll 35, enters the pair of work rolls 12 and 13 and then the pair of work rolls 11 and 13, loops around the deflecting roll 34 and is finally wound around the coiling apparatus 5.

From this point on, the operation of the second and the third embodiments of FIG. 26 is similar to that of the mill according to FIG. 12. The rotation of the work rolls and the motion of the strips 3, 3*a*, 3*b* are shown on FIG. 26 by arrows.

The use of the mill according to FIG. 26 makes it possible to increase its efficiency, since the strip is reduced in it four times per pass.

Figure 27:
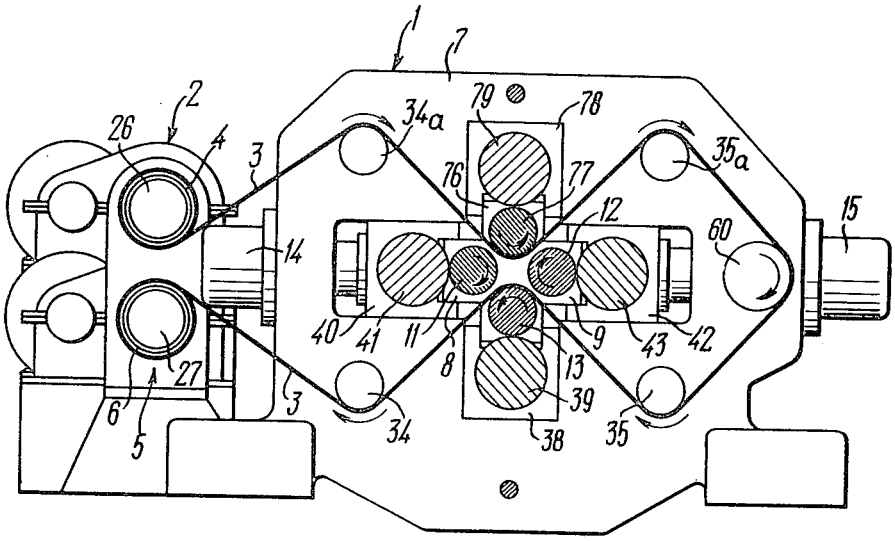
FIG. 27 is a side view similar to FIG. 26, but the mill is provided additionally with one backup roll per work roll.

FIG. 27 illustrates a mill which differs from the mill shown in FIG. 26 in that each of the four work rolls 11, 77, 12 and 13 contacts a respective backup roll (backup rolls 41, 79, 43 and 39 respectively). The principle underlying the arrangement of the backup rolls in the mill according to FIG. 27 is the same as that in the mill shown on FIG. 8.

The use of the mill according to FIG. 27 makes it possible, along with a substantial increase in its efficiency, to decrease the diameters of the work rolls 11, 77, 12 and 13, to increase the deformations of strip, to minimize the pressure of metal upon the rolls and to roll thinner strips.

Figure 28:
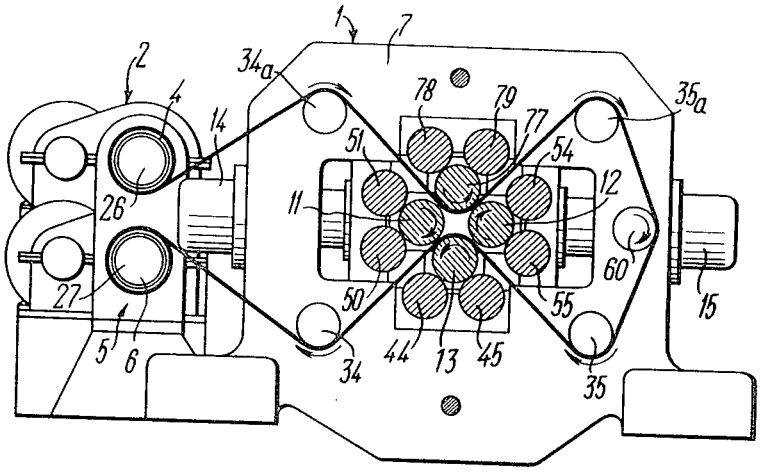
FIG. 28 is a side view similar to FIG. 26, but the mill is provided additionally with two backup rolls per work roll.

FIG. 28 illustrates a mill whose particularity, as compared to the mill shown in FIG. 26, is that each of the four work rolls 11, 77, 12 and 13 contacts two respective backup rolls (pairs of backup rolls 50 and 51, 78 and 79, 54 and 55 and 44 and 45 respectively). The principle underlying the arrangement of the backup rolls in the mill according to FIG. 28 is the same as that in the mill shown on FIG. 11.

The use of the mill according to FIG. 28 makes it possible, along with a substantial increase in its efficiency, to reduce the diameter of the work rolls 11, 77, 12 and 13, to minimize the pressure of metal upon the rolls, to increase the deformation of strip and to roll thinner strips.

Figure 29:
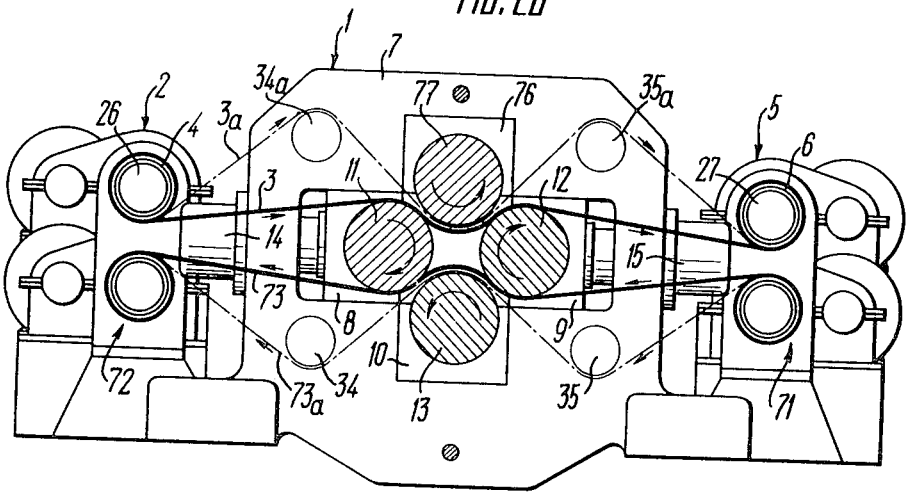
FIG. 29 is a side elevational view, partly in cross section, of a mill for rolling metal strip, realized according to the invention, having four work rolls, a decoiling and a coiling apparatus being provided additionally on both sides of the stand for simultaneous rolling of two strips.

FIG. 29 illustrates a mill differing from the mill shown in FIGS. 3 and 5 in that an additional middle work roll 77, rotated by a drive means in the same direction as the first middle work roll 13, is arranged in the working stand 1 in chock 76 symmetrically with respect to the plane passing through the axes of the extreme work rolls 11 and 12. Moreover, a decoiling apparatus 71 and a coiling apparatus 72 are additionally provided in said mill to make possible the rolling of the strip 73 simultaneously with that of the strip 3. The rotation of the work rolls 11, 12, 13 and 77 and the motion of the strip 3 and 73 are shown on FIG. 29 by arrows. An alternative path of motion in the mill of the strips 3*a* and 73*a* is shown on FIG. 29 in broken lines. In this case, to prevent contact of the strips 3*a* and 73*a* with the work rolls prior to entry and after exit from said work rolls use is made of the deflecting rolls 34, 35, 34*a* and 35a.

The mill shown on FIG. 29 operates as follows. The strip 3 to be rolled is fed from the decoiling apparatus 2 to the work stand 1, engages the pair of work rolls 11 and 77 and then the pair of work rolls 77 and 12, and is wound around the mandrel of the coiling machine 5 wherein the leading edge of the strip is secured. In another alternative embodiment, the strip 3a is fed by the decoiling apparatus 2 from the coil 4 to the deflecting roll 34a, passes around it, enters the pair of work rolls 11 and 77 and then the pair of work rolls 77 and 12, goes around the deflecting roll 35a and is wound around the mandrel of the coiling apparatus 5, wherein the leading edge of the strip **3*a*** is secured.

The threading of the second strip 73 (first alternative embodiment) or strip **73*a* (second alternative embodiment) is similar to the above procedure. From this point on, the operation of the mill according to FIG. 29 is similar to that of the mill shown on FIG. 16**.

Figure 30:
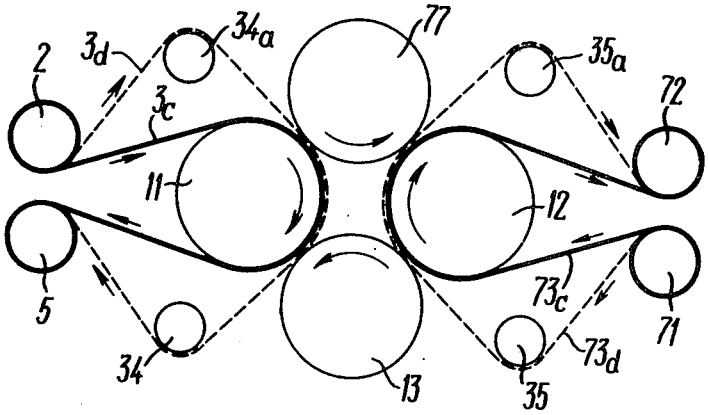
FIG. 30 is a schematic diagram of an alternative embodiment of the mill for rolling metal strip illustrated in FIG. 29.

FIG. 30 illustrates another two alternative paths of motion of the strips **3*c*, 3*d*, 73*c*, and 73*d* being rolled and the arrangement of the decoiling apparatus 2 and 71 and the coiling apparatus 5 and 72 with respect to the work rolls 11, 77, 12 and 13. The decoiling apparatus 2 and the coiling apparatus 5 intended for handling the strips 3*c* and 3*d* are located on the same side of said work rolls, and the decoiling apparatus 71 and the coiling apparatus 72 intended for handling strips 73*c* and 73*d*** are placed on the opposite side of said work rolls.

The mill according to FIG. 30 operates as follows. The strip 3c from the decoiling apparatus 2 is fed to the work stand, engages the pair of work rolls 11 and 77, passes around the work roll 11, enters the pair of work rolls 11 and 13 and is wound on the coiling apparatus 5. The strip 73c from the decoiling apparatus 71 is fed to the working stand, engages the pair of work rolls 12 and 13, passes around the work roll 12, enters the pair of work rolls 12 and 77 and is wound on the coiling apparatus 72.

According to the second alternative path (broken line), the strips 3d and 73d prior to entry into the first pair of work rolls and after exit from the second pair of work rolls pass around the deflecting rolls **34*a* and 34 and 35 and 35*a***, respectively.

From this point on, the mill according to FIG. 30 operates similarly to the mill shown on FIG. 17.

The use of the mills according to FIGS. 29 and 30 makes it possible to substantially increase their efficiency, since two strips are rolled simultaneously.

Figure 31:
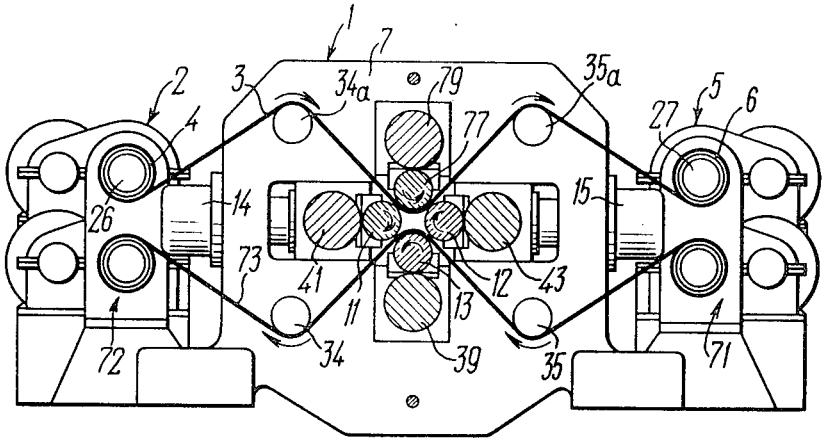
FIG. 31 is a side view similar to FIG. 29, but each extreme work roll is provided additionally with a backup roll.

FIG. 31 illustrates a mill differing from the mill shown in FIG. 29 in that each of the four work rolls 11, 12, 13 and 77 contacts a respective backup roll (backup rolls 41, 43, 39 and 79 respectively). The principle underlying the arrangement of the rolls in said mill is the same as that in the mill shown on FIG. 8.

The use of the mill shown in FIG. 31 makes it possible, in addition to increasing its efficiency, to reduce the diameters of the work rolls 11, 12, 13 and 77, to minimize the pressure of metal upon the rolls, to increase the deformation of strip and to roll thinner strips.

Figure 32:
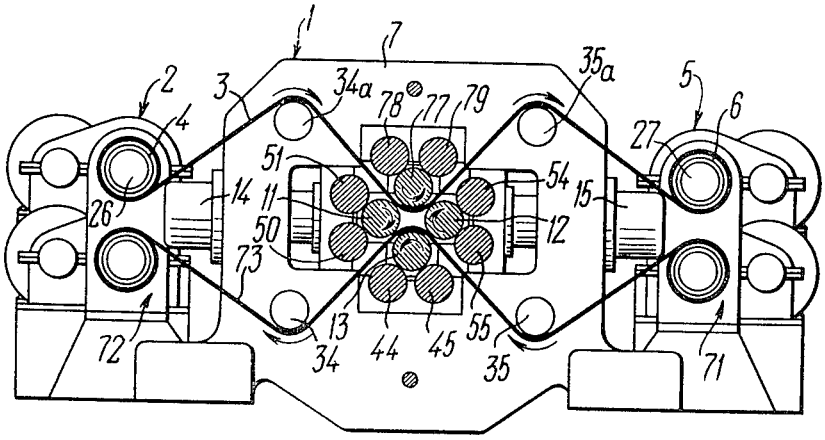
FIG. 32 is a side view similar to FIG. 29, but each work roll is provided additionally with two backup rolls.

FIG. 32 illustrates a mill differing from the mill shown in FIG. 29 in that each of the four work rolls 11, 12, 13 and 77 contacts two respective backup rolls (pairs of backup rolls 50 and 51, 54 and 55, 44 and 45 and 78 and 79 respectively). The principle underlying the arrangement of the backup rolls in the mills in accordance with the FIG. 32 is the same as that in the mill shown on FIG. 11.

The use of the mill shown in FIG. 32 makes it possible, along with an increase in its efficiency, to reduce the diameters of the work rolls 11, 12, 13 and 77, to reduce the pressure of metal upon the rolls, to increase the deformation of strips and to roll thinner strips. In addition, the work rolls of said mill are locked in position in the planes parallel to those passing through the axes of the pairs of the backup rolls contacting them.

We claim:

1. A mill for rolling metal strips, comprising: a stationary working stand having a housing; at least three work rolls mounted in said stand and cooperating successively through the strip being rolled, at least two of said rolls being secured in chocks placed in said housing of the working stand, the axis of a middle work roll being offset with respect to a plane passing through the axes of the extreme work rolls in the direction of entry of the strip being rolled into a first pair of said work rolls, defined by said middle work roll and a first extreme work roll along the path of rolling, and of exit of the strip from a second pair of work rolls, defined by said middle work roll and a second extreme work roll; drive means for rotating said work rolls in opposite directions at different peripheral speeds increasing along the path of rolling; a screw down for at least one of said work rolls; means for decoiling the strip; means for coiling the strip; and a deflecting roll mounted on said housing and arranged with respect to said middle work roll on the opposite side of a plane passing through the axes of said extreme work rolls, the axis of said deflecting roll being in a plane passing through the axis of said middle work roll perpendicularly to the plane passing through the axes of said extreme work rolls.

2. A mill for rolling metal strips according to claim 1, wherein on said housing of the working stand on the side of said middle work roll at least one other deflecting roll is mounted and located in the manner that a tangent drawn to said deflecting roll and said middle work roll is perpendicular to a line connecting the axes of said middle work roll and of a respective extreme work roll adjoining the deflecting roll.

3. A mill for rolling metal strips as claimed in claim 1, wherein on said housing of the working stand at least one other deflecting roll is mounted and located on the side of a respective extreme work roll within a sector limited on one side by a tangent to said middle work roll at its point of contact with said respective extreme work roll and on the other side by a line drawn from the center of said middle work perpendicularly to a line connecting the axes of said extreme work rolls.

4. A mill for rolling metal strips according to claim 2, further comprising at least one backup roll mounted in said housing and contacting a respective extreme work roll, the backup roll axis being located in a plane passing through the axes of said respective extreme work roll and said middle work roll; and at least one backup roll mounted in said housing and contacting said middle work roll, the axis of said backup roll being in a plane passing through the axis of said middle work roll perpendicularly to a plane passing through the axes of said extreme work rolls.

5. A mill for rolling metal strips according to claim 4, further comprising at least two backup rolls mounted in said housing and contacting a respective extreme work roll, the axes of the backup rolls being in a plane perpendicular to a plane passing through the axes of said respective extreme work roll and said middle work roll; and at least two backup rolls mounted in said housing and contacting said middle work roll, the axes of the backup rolls being in a plane parellel to a plane passing through the axes of said extreme work rolls.

6. A mill for rolling metal strips as claimed in claim 2, wherein in said working stand between said middle work roll and said deflecting roll in the plane passing through the axis of said middle work roll and the deflecting roll an odd number of intermediate rolls are mounted in a manner such that said deflecting roll, at least one of said intermediate rolls and said middle work roll successively contact one another, the diameter of said intermediate rolls being such that it clears said extreme work rolls.

7. A mill for rolling metal strips according to claim 3, wherein in said working stand between said middle work roll and said deflecting roll in the plane passing through the axis of said middle work roll and the deflecting roll an odd number of intermediate rolls are mounted in a manner such that said deflecting roll, at least one of said intermediate rolls and said middle work roll succesively contact one another, the diameter of said intermediate rolls being such that it clears said extreme work rolls.

8. A mill for rolling metal strips according to claim 6, further comprising at least one backup roll mounted in said housing and contacting a respective extreme work roll, the backup roll axis being located in a plane passing through the axes of said respective extreme work roll and said middle work roll; and at least one backup roll mounted in said housing and contacting said middle work roll, the axis of said backup roll being in a plane through the axis of said middle work roll perpendicular to a plane passing through the axes of said extreme work rolls.

9. A mill for rolling metal strips according to claim 8, further comprising at least two backup rolls mounted in said housing and contacting a respective extreme work roll, the axes of the backup rolls being in a plane perpendicular to a plane passing through the axes of said respective extreme work roll and said middle work roll; and at least two backup rolls mounted in said housing and contacting said middle work roll, the axes of the backup rolls being in a plane parallel to a plane passing through the axes of said extreme work rolls.

* * * * *